US012605589B2

(12) United States Patent
Lester

(10) Patent No.: US 12,605,589 B2
(45) Date of Patent: Apr. 21, 2026

(54) METHOD AND APPARATUS FOR AN EXERCISE MACHINE

(71) Applicant: Timothy L. Lester, Smyrna, GA (US)

(72) Inventor: Timothy L. Lester, Smyrna, GA (US)

(73) Assignee: Timothy L. Lester, Smyrna, GA (US)

( * ) Notice: Subject to any disclaimer, the term of this patent is extended or adjusted under 35 U.S.C. 154(b) by 75 days.

(21) Appl. No.: 18/913,458

(22) Filed: Oct. 11, 2024

(65) Prior Publication Data

US 2025/0121249 A1 Apr. 17, 2025

Related U.S. Application Data

(60) Provisional application No. 63/589,766, filed on Oct. 12, 2023.

(51) Int. Cl.
*A63B 21/00* (2006.01)
*A63B 21/02* (2006.01)
*A63B 21/04* (2006.01)

(52) U.S. Cl.
CPC ..... *A63B 21/4047* (2015.10); *A63B 21/023* (2013.01); *A63B 21/0421* (2013.01); *A63B 21/4033* (2015.10); *A63B 21/4039* (2015.10); *A63B 2210/50* (2013.01)

(58) Field of Classification Search
CPC ..... A63B 21/4047; A63B 21/023; A63B 21/0421; A63B 21/4033; A63B 21/4039; A63B 2210/50; A63B 2225/09; A63B 2225/093
See application file for complete search history.

(56) References Cited

U.S. PATENT DOCUMENTS 5,333,604 A * 8/1994 Green ..... A61H 1/0255 601/33
6,001,051 A * 12/1999 Chuan-Pin ..... A63B 21/0552 482/142
6,090,023 A * 7/2000 Liu ..... A63B 21/4047 482/130
6,238,320 B1 * 5/2001 Flanagan ..... A63B 3/00 482/130
7,137,934 B2 * 11/2006 Paramater ..... A63B 21/159 482/130
7,341,547 B2 * 3/2008 Liao ..... A63B 21/0004 482/140
7,695,416 B2 * 4/2010 Weiner ..... A61H 1/024 482/137

(Continued)

*Primary Examiner* — Garrett K Atkinson
(74) *Attorney, Agent, or Firm* — Quinn IP Law

(57) ABSTRACT

A therapeutic exercise machine includes a platform having foldable legs; vertical support brackets affixed to the platform; a resistance bar assembly having a resistance bar affixed to rotation retaining plates via pivot arms; mechanical resistance devices; spring support arms; a back brace; and a knee bolster. The knee bolster is affixed to the platform. The rotation retaining plates are rotatably attached to distal ends of the vertical support brackets; First ends of the first and second mechanical resistance devices are attached to the spring support arms, and second ends of the mechanical resistance devices are attached to the rotation retaining plates. The mechanical resistance devices are arranged to resist rotation of the horizontal resistance bar about an axis of rotation defined by the distal ends of the vertical support brackets.

20 Claims, 5 Drawing Sheets

(56) References Cited

U.S. PATENT DOCUMENTS 8,790,227 B2 * 7/2014 Meister ..... A63B 21/4033 482/141
8,801,640 B2 * 8/2014 Sevy ..... A63B 23/03508 601/24
9,278,244 B2 * 3/2016 Chuang ..... A63B 21/00181
9,713,740 B1 * 7/2017 Chen ..... A63B 21/4033
10,123,736 B2 * 11/2018 Malone ..... A63B 21/4039
12,403,059 B1 * 9/2025 Thornton ..... A61H 1/024
2003/0130097 A1 * 7/2003 Harrison ..... A63B 23/0494 482/122
2005/0159688 A1 * 7/2005 Sakamoto ..... A61H 15/0092 601/123
2006/0217249 A1 * 9/2006 Webber ..... A63B 23/02 482/142
2008/0182730 A1 * 7/2008 Conley ..... A61H 1/0244 482/95
2011/0237406 A1 * 9/2011 Reyes ..... A63B 23/0233 482/94
2012/0115693 A1 * 5/2012 Franques ..... A63B 23/0211 482/140
2013/0197403 A1 * 8/2013 Sevy ..... A63B 23/0494 601/5
2013/0211297 A1 * 8/2013 Method ..... A61H 1/0237 601/34
2014/0038798 A1 * 2/2014 Littell ..... A63B 23/0211 482/145
2014/0066271 A1 * 3/2014 Gray ..... A63B 21/4031 482/131
2014/0073998 A1 * 3/2014 Keiser ..... A61H 1/024 601/34
2014/0094721 A1 * 4/2014 Diallo ..... A63B 24/0087 601/5
2014/0276273 A1 * 9/2014 Leismer ..... A63B 23/0405 601/49
2014/0296042 A1 * 10/2014 Snyder ..... A63B 21/4047 482/137
2016/0279011 A1 * 9/2016 Lutz ..... A61H 1/024
2016/0367427 A1 * 12/2016 Malone ..... A61H 1/024
2017/0036052 A1 * 2/2017 Wang ..... A63B 21/0552

* cited by examiner

METHOD AND APPARATUS FOR AN EXERCISE MACHINE

CROSS-REFERENCE TO RELATED APPLICATIONS

This application claims the benefit of U.S. Provisional Patent Application No. 63/589,766 filed on Oct. 12, 2023, the disclosure of which is hereby incorporated by reference.

INTRODUCTION

Low back and neck pain is an increasingly widespread and expensive condition worldwide, costing the US $88 billion a year. Among adults, 60% to 80% will experience back pain and up to 70% to 75% of people will experience neck pain that interferes with their daily activities during their lifetimes. At any given time, 15% to 20% of adults will report having back pain symptoms. Lower back is the second most common reason why an individual will see a doctor. One of the primary reasons for lower back pain is weak core muscles. Having an effective home exercise machine that may simultaneously isolate several core muscles in one exercise motion may help strengthen the muscles that contribute to lower back pain and thus reduce chronic lower back pain.

Neck pain affects 30% to 50% of adults in the general population in any given year. Approximately 50% to 85% of individuals with neck pain do not experience complete resolution of symptoms. There is a need for an effective home exercise machine that may isolate and strengthen neck muscles that contribute to neck pain and thus reduce chronic neck pain.

SUMMARY

Described herein is a therapeutic exercise machine and system that may be advantageously employed for strengthening neck and/or back muscles of a user, and more specifically a therapeutic exercise machine and system for therapeutic muscle strengthening for cervical and/or lumbar portions of the body of a user. The method and device may be compatible with electronic instruction and usage monitoring. The exercise device and system may be employed as an element of a therapeutic activity to strengthen targeted muscles.

The disclosure relates to gym exercise machines, home exercise devices, lower back physical therapy, neck/cervical physical therapy and home exercise devices and methods for exercising the neck/cervical and lower back or lumbar muscles. They may also be applicable to other muscles and joints of the human body.

An aspect of the disclosure may include a therapeutic exercise machine that includes a platform having a plurality of legs; first and second vertical support brackets affixed to the platform and proximal to a first end thereof; a resistance bar assembly having a resistance bar affixed to first and second rotation retaining plates via first and second pivot arms; first and second mechanical resistance devices; first and second spring support arms; a back brace; and a knee bolster. The knee bolster is affixed to a second end of the platform. The first and second rotation retaining plates are rotatably attached to distal ends of the first and second vertical support brackets; First ends of the first and second mechanical resistance devices are attached to the first and second spring support arms, and second ends of the first and second mechanical resistance devices are attached to the first and second rotation retaining plates. The first and second mechanical resistance devices are arranged to resist rotation of the horizontal resistance bar about an axis of rotation defined by the distal ends of the first and second vertical support brackets.

Another aspect of the disclosure may include the therapeutic exercise machine being arrangeable in a deployed state and a non-deployed state, wherein elements of the therapeutic exercise machine may be folded, disassembled, collapsed, or retracted.

Another aspect of the disclosure may include the therapeutic exercise machine being arranged in the non-deployed state with one or more of the legs, the resistance bar assembly, the first and second mechanical resistance devices, and the first and second spring support arms being folded, disassembled, collapsed, or retracted onto the platform.

Another aspect of the disclosure may include a plurality of wheels being arranged on the first end of the platform, wherein the plurality of wheels are in a bottom-most position on the therapeutic exercise machine when the therapeutic exercise machine is in the non-deployed state.

Another aspect of the disclosure may include the legs, resistance bar assembly, first and second mechanical resistance devices, first and second spring support arms being folded, disassembled, collapsed, or retracted onto the platform for stowing.

Another aspect of the disclosure may include the platform being horizontally disposed and supported on the legs when the therapeutic exercise machine is in the deployed state.

Another aspect of the disclosure may include the back brace being affixed to the first end of the platform.

Another aspect of the disclosure may include the back brace being attached to and suspended between the vertical support brackets.

Another aspect of the disclosure may include the knee bolster having an adjustable mounting bracket, wherein the adjustable mounting bracket facilitates positioning of the knee bolster in relation to the platform. This facilitates the knee bolster being adjustable to fit overtop of a user's legs, allowing the user's legs and leg muscles to be immobilized such that force exerted by the user on the resistance bar originates from the user's core and back, and not the legs.

In one embodiment, a seatbelt may be employed to secure a user's legs and pelvic area to the platform, with the knee bolster and the seatbelt acting to immobilize the user such that force exerted by the user on the resistance bar originates from the user's core and back, and not the legs.

Another aspect of the disclosure may include the knee bolster, the back brace and the platform being arranged to secure a user therein to effect exercise therapy.

Another aspect of the disclosure may include the first and second rotation retaining plates having eccentric brackets, wherein the second ends of the first and second mechanical resistance devices are attached to the eccentric brackets of the first and second rotation retaining plates.

Another aspect of the disclosure may include the mechanical resistance device being one of an electro-mechanical resistance device, a mechanical spring, a friction device, a pneumatic cylinder, a hydraulic cylinder, a linear actuator, an electro-magnetic device, an elastomer band, or mechanical gearing.

Another aspect of the disclosure may include the mechanical resistance device being controllable to adjust a magnitude of mechanical force exertable by the mechanical resistance device.

Another aspect of the disclosure may include the first and second mechanical resistance devices being spiral wound torsion springs, and wherein the spiral wound torsion springs are disposed within one of the first and second rotation retaining plates.

Another aspect of the disclosure may include a controller in the form of an electronic computerized instructional device or application that is linked with other elements of the therapeutic exercise machine via wires, radio frequency, Bluetooth, WiFi, cellular, or another communication system to communicate an exercise regimen to a user, and is some cases to enable the collection of usage data and other parameters.

The above summary is not intended to represent every possible embodiment or every aspect of the present disclosure. Rather, the foregoing summary is intended to exemplify some of the novel aspects and features disclosed herein. The above features and advantages, and other features and advantages of the present disclosure, will be readily apparent from the following detailed description of representative embodiments and modes for carrying out the present disclosure when taken in connection with the accompanying drawings and the claims.

BRIEF DESCRIPTION OF THE DRAWINGS

One or more embodiments will now be described, by way of example, with reference to the accompanying drawings, in which.

Figure 1:
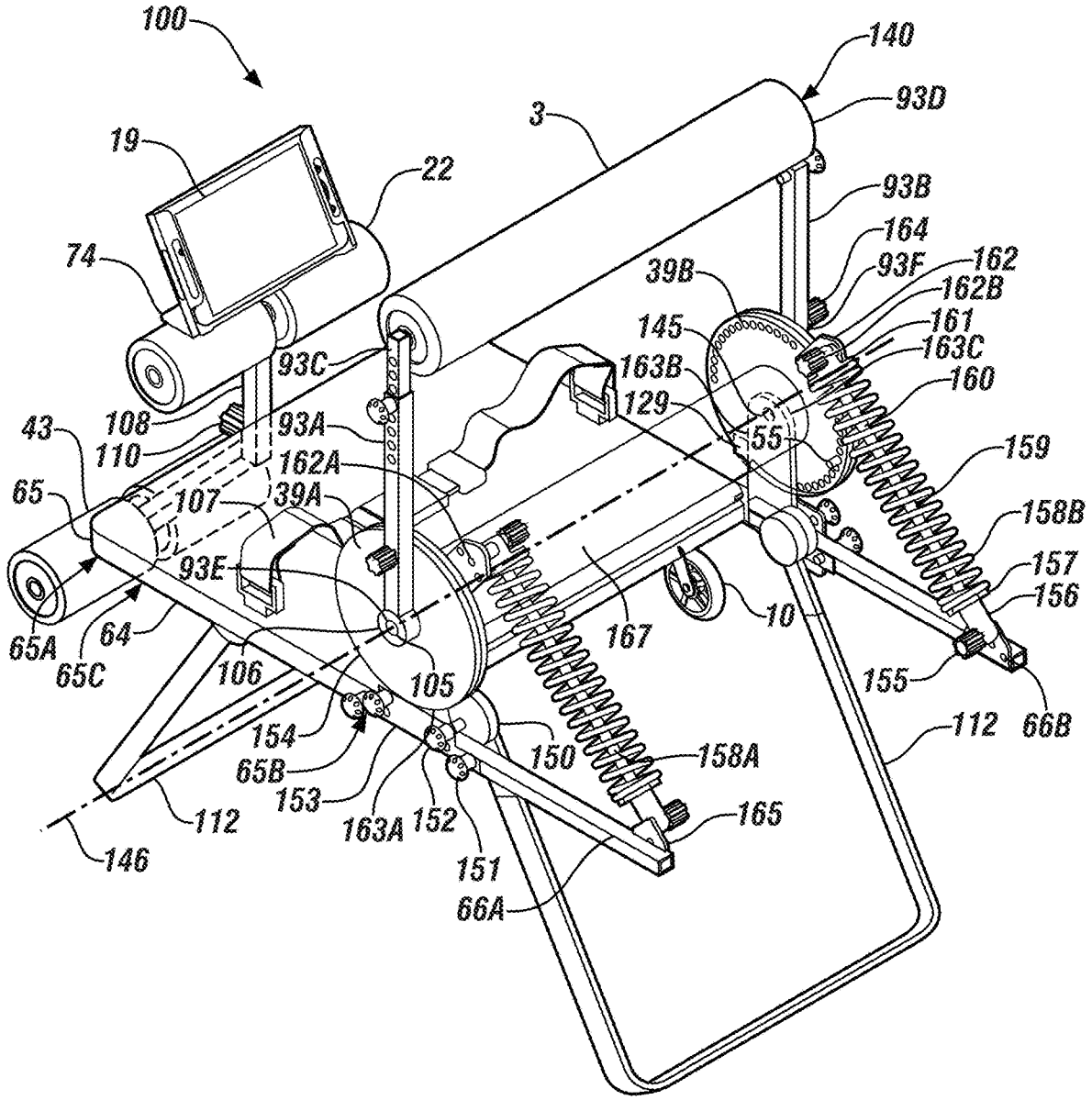
FIG. 1 schematically illustrates an isometric view of an embodiment of a therapeutic exercise machine in a deployed state, in accordance with the disclosure.

The appended drawings are not necessarily to scale, and may present a somewhat simplified representation of various features of the present disclosure as disclosed herein, including, for example, specific dimensions, orientations, locations, and shapes. Details associated with such features will be determined in part by the particular intended application and use environment.

DETAILED DESCRIPTION

The components of the disclosed embodiments, as described and illustrated herein, may be arranged and designed in a variety of different configurations. Thus, the following detailed description is not intended to limit the scope of the disclosure, as claimed, but is merely representative of possible embodiments thereof. In addition, while numerous specific details are set forth in the following description to provide a thorough understanding of the embodiments disclosed herein, some embodiments may be practiced without some of these details. Moreover, for the purpose of clarity, certain technical material that is understood in the related art has not been described in detail to avoid unnecessarily obscuring the disclosure.

For purposes of convenience and clarity, directional terms such as top, bottom, left, right, up, over, above, below, beneath, rear, and front, may be used with respect to the drawings. These and similar directional terms are not to be construed to limit the scope of the disclosure. Furthermore, the disclosure, as illustrated and described herein, may be practiced in the absence of an element that is not specifically disclosed herein.

The following detailed description is merely illustrative in nature and is not intended to limit the application and uses. Furthermore, there is no intention to be bound by any expressed or implied theory presented herein. Throughout the drawings, corresponding reference numerals indicate like or corresponding parts and features.

For the sake of brevity, known components and techniques and other functional aspects of the systems (and the individual operating components of the systems) may not be described in detail herein. Furthermore, the connecting lines shown in the various FIGURES contained herein are intended to represent example functional relationships and/or physical couplings between the various elements. Many alternative or additional functional relationships or physical connections may be present in an embodiment.

The use of ordinals such as first, second and third does not necessarily imply a ranked sense of order, but rather may distinguish between multiple instances of an act or structure.

All numerical values of parameters (e.g., of quantities or conditions) in this specification, including the appended claims, are to be understood as being modified in all instances by the term "about" whether or not "about" actually appears before the numerical value. "About" indicates that the stated numerical value allows some slight imprecision (with some approach to exactness in the value; about or reasonably close to the value; nearly). If the imprecision provided by "about" is not otherwise understood in the art with this ordinary meaning, then "about" as used herein indicates at least variations that may arise from ordinary methods of measuring and using such parameters. In addition, disclosure of ranges includes disclosure of all values and further divided ranges within the entire range. Each value within a range and the endpoints of a range are hereby all disclosed as separate embodiment.

Figure 2:
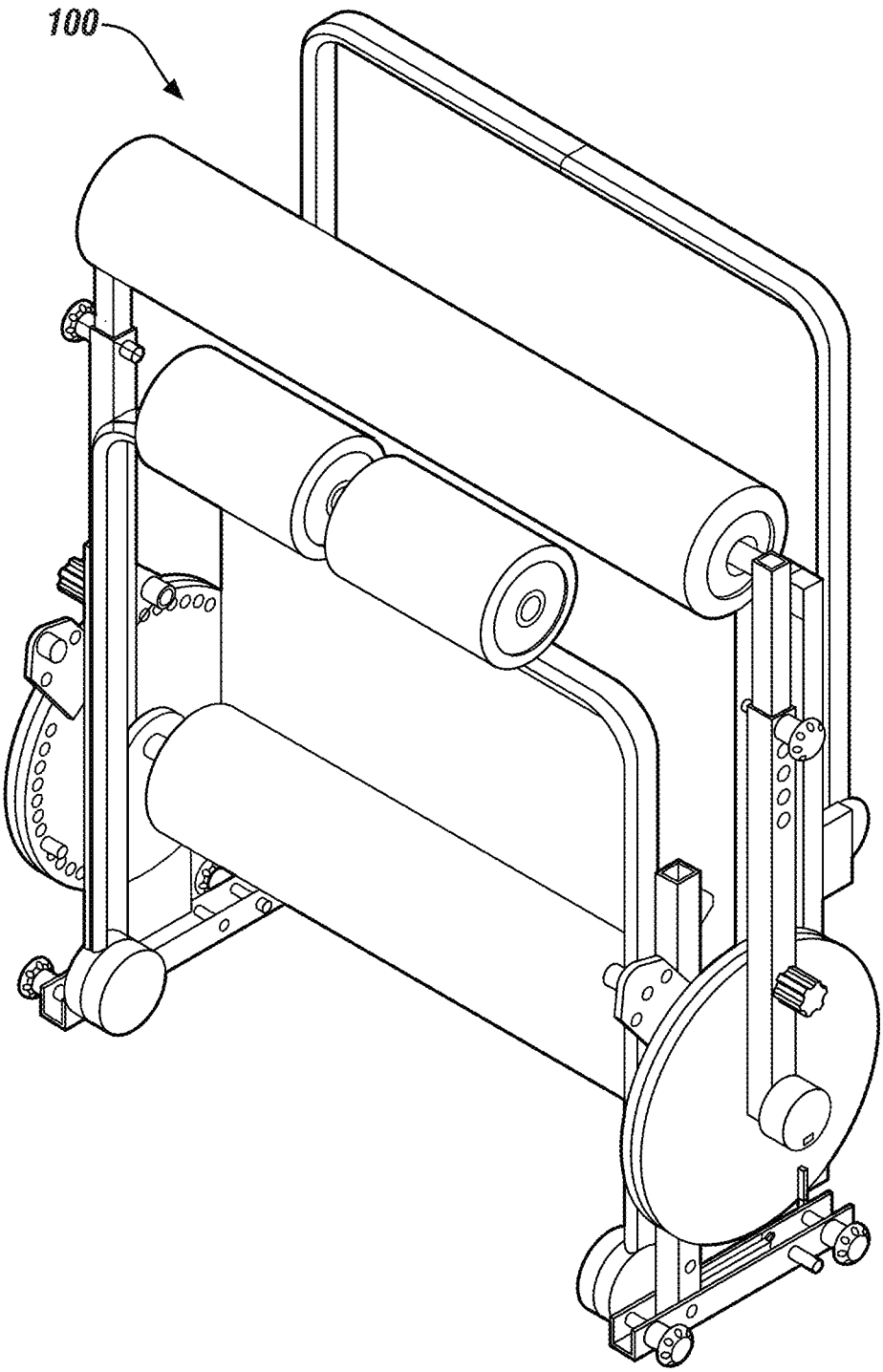
FIG. 2 schematically illustrates an isometric view of the embodiment of the therapeutic exercise machine described with reference to FIG. 1 in a non-deployed state, in accordance with the disclosure.

Referring to the drawings, wherein like reference numerals correspond to like or similar components throughout the several Figures, FIGS. 1 and 2 schematically illustrate an embodiment of a therapeutic exercise machine 100, which may be employed in various exercise regimens for exercising muscles of the neck and/or lower back in either or both a clinical setting and a home setting. FIG. 1 depicts the therapeutic exercise machine 100 arranged in a deployed state, i.e., in-use. FIG. 2 depicts the therapeutic exercise machine 100 arranged in a non-deployed state, wherein elements of the therapeutic exercise machine 100 may be folded, disassembled, collapsed, or retracted.

Figure 3:
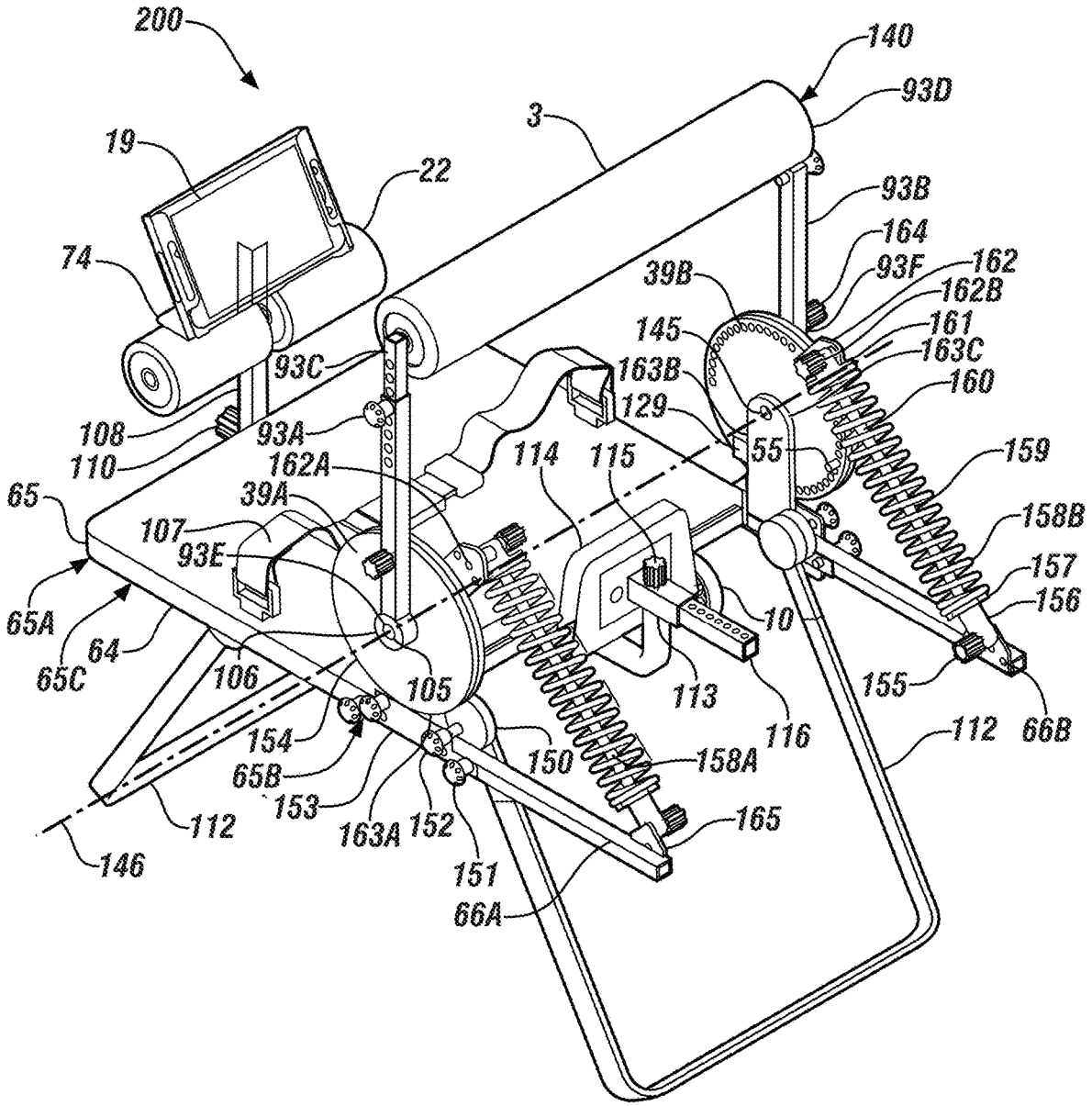
FIG. 3 schematically illustrates an isometric view of a second embodiment of the therapeutic exercise machine in a deployed state, in accordance with the disclosure.

Elements indicated by numerals are shown in one of or both of FIGS. 1 and 3.

The therapeutic exercise machine 100 includes a platform 65, a plurality of legs 112, first and second vertical support brackets 163A, 163B, respectively, a resistance bar assembly 140, a back brace 114, a knee bolster 22, first and second mechanical resistance elements 158A, 158B, respectively, first and second spring support arms 66A, 66B, respectively, and one of a plurality of wheels 10.

In one alternative embodiment, a single one of the mechanical resistance elements 158A, 158B may be employed.

As shown with reference to FIG. 1, the platform 65 is horizontally disposed on the plurality of legs 112, which project orthogonally from the platform 65 when in the deployed state. Ends of the plurality of legs 112 that are distal to the platform 65 are arranged and configured to permit the platform 65 to rest on a horizontal surface, such as a floor of a building. The plurality of legs 112 are fixedly secured to the platform 65 employing brackets or other mechanisms in the deployed state. As shown with reference to FIG. 2, the plurality of legs 112 are arranged to be folded, collapsed, disassembled, or removed from the platform 65 when the platform 65 is in the non-deployed state.

Referring again to FIG. 1, the platform 65 has a rectangular surface in one embodiment, with a frame 64 on which the first and second vertical support brackets 163A, 163B, the knee bolster 22, the first and second spring support arms 66A, 66B, and the casters 10 may be attached, affixed, or otherwise secured. The platform 65 includes a first end 65A and an opposed second end 65B, and opposed sides 65C.

In this embodiment, the back brace 114 is a padded tubular element that is attached to and suspended between the vertical support brackets 163A, 163B on the first end 65A of the platform 65.

The plurality of wheels 10 may be arranged on and attached to the first end 65A of the platform 65. The plurality of wheels 10 may be suspended from a bottom portion of the platform 65 and thus out of the way of a user when the therapeutic exercise machine 100 is in the deployed state. The wheels 10 are advantageously located in a bottom-most position on the therapeutic exercise machine 100 when in the non-deployed state.

The platform 65 including frame 64 may be fabricated from wood, steel, aluminum, polymeric material, or another material. The platform 65 may include a cushioned pad or an upholstered seat in one embodiment. A seatbelt 107 may be advantageously coupled to the platform 65, and is employable to fix the pelvis of the user in place to secure the user to the seat during execution of an exercise regimen.

The knee bolster 22 is arranged on and movably affixed to the second end 65B of the platform 65 via a bracket 108 and removable fastener 110. This arrangement facilitates the knee bolster 22 being adjustable to fit overtop of a user's legs during execution of an exercise regimen. Stated differently, an adjustable knee pad assembly that includes the knee bolster 22, bracket 108 and fastener 110 may be attached to the frame 64 and positioned in relation to the platform 65 to isolate and immobilize the leg muscles of the user during execution of an exercise regimen such that force exerted by the user on the resistance bar 3 originates from the user's core and back, and not the legs. In one embodiment, an adjustable lower leg bolster 43 may be connected to the frame 64 and/or the chair leg 112, and be adjustable to position the feet and lower legs of a user to further isolate and immobilize the leg muscles of the user during execution of an exercise regimen such that force exerted by the user on the resistance bar 3 originates from the user's core and back, and not the legs. In one embodiment, a mounting bracket 74 is affixed above the knee bolster 22, and may be employed to support a controller 19 thereon, for viewing and other interaction with a user. The controller 19 may be in the form of a personal computer, tablet, cellular phone, or another device.

The first and second vertical support brackets 163A, 163B are secured to the frame 64 on opposed sides 65C at the second end 65B of the platform 65, and project upwardly when the therapeutic exercise machine 100 is in the deployed state. The first and second vertical support brackets 163A, 163B have ends 163C that are distal from the platform 65, with respective apertures 145 (illustrated with reference to FIG. 3) formed therein. The apertures 145 define an axis of rotation 146. The axis of rotation 146 is physically manifested by a rotation bar pivot axle 105.

The first and second spring support arms 66A, 66B are secured to the frame 64 at the second end 65B of the platform 65, projecting horizontally outward therefrom in the deployed state. In one embodiment, the first and second spring support arms 66A, 66B are secured to the frame 64 via pivot hinges 153, which enable the first and second spring support arms 66A, 66B to fold upwardly to attain the non-deployed state in one embodiment. Alternatively, the first and second spring support arms 66A, 66B are telescoping elements that are slidably arranged in the frame 64, and slidably collapse into the frame 64 to attain the non-deployed state. Each of the first and second spring support arms 66A, 66B includes, in one embodiment, a lower attachment bracket 165, which is employed to secure a first, lower end 156 of one of the first and second mechanical resistance elements 158A, 158B, in one embodiment. The first and second mechanical resistance elements 158A, 158B are advantageously disconnected from one or both the first and second spring support arms 66A, 66B and/or first and second outer eccentric brackets 162A, 162B of the first and second rotation retaining plates 39A, 39B prior to arranging the therapeutic exercise machine 100 in the non-deployed state.

The resistance bar assembly 140 includes a horizontally-disposed resistance bar 3, the first and second rotation retaining plates 39A, 39B, and first and second pivot arms 93A, 93B. The resistance bar 3 is affixed to the first and second rotation retaining plates 39A, 39B via the first and second pivot arms 93A, 93B, respectively. The resistance bar assembly 140 is rotatably assembled onto the first and second vertical support brackets 163A, 163B at respective apertures 145 via the rotation bar pivot axles 105.

The first and second pivot arms 93A, 93B are arranged as telescoping beams, which permits length adjustment and associated height adjustment of the resistance bar 3 to accommodate users of various sizes. The height adjustment of the resistance bar 3 permits adaptation to users of varying heights and trunk lengths, and adaptation to permit selective location of the resistance bar 3 in relation to various anatomical positions on the user's body, such as head, neck, shoulders, middle back, etc. The first and second pivot arms 93A, 93B have respective first ends 93C, 93D, and respective second ends 93E, 93F.

The horizontally-disposed resistance bar 3 is attached to and spans between the first ends 93C, 93D of the first and second pivot arms 93A, 93B.

Each of the first and second rotation retaining plates 39 is configured as a plate having a center aperture. Each of the first and second rotation retaining plates 39 includes a respective first or second outer eccentric bracket 162A, 162B.

The second ends 93E, 93F of the first and second pivot arms 93A, 93B, and the first and second rotation retaining plates 39A, 39B are rotatably attached to the apertures 145 formed in the vertical support brackets 163 via pins, axle portions, etc. The second ends 93E, 93F of the first and second pivot arms 93A, 93B, are also attached the first and second rotation retaining plates 39A, 39B at first and second outer eccentric brackets 162A, 162B via pins 164. This arrangement enables torque to be transmitted between the horizontally-disposed resistance bar 3 and the first and second rotation retaining plates 39A, 39B.

In one embodiment, each of the first and second mechanical resistance elements 158A, 158B includes the first lower end 156 that is affixed to a respective one of the first and second spring support arms 66A, 66B, and a second, upper end 161 that is affixed to a respective one of the first and second outer eccentric brackets 162A, 162B.

Other elements include folding leg lock 150, which is affixed to the frame 64 and facilitates the legs 112 to be positioned at a desired angle, or locked in an upward position for transport. Locking pin 151 may be employed to lock the first and second spring support arms 66A, 66B in place via the pivot hinges 153 for deployment. Locking pin 152 may be employed to lock the first and second spring support arms 66A, 66B in upward positions via the pivot hinges 153 for transport.

The pivot hinges 153 connect the frame 64 with the first and second spring support arms 66A, 66B and the first and second vertical support brackets 163A, 163B, thus providing a pivot for deployment of the therapeutic exercise machine 100 or for storage of the therapeutic exercise machine 100.

A pivot arm rotation plate 154 connects the first and second rotation retaining plates 39A, 39B to a rotation bar pivot housing 106 and first and second pivot arms 93A, 93B via a locking pin, allowing them to rotate (under load) via the rotation bar pivot axle 105 around the axis of rotation 146. When the pin is released, the first and second rotation retaining plates 39A, 39B and the rotation bar pivot housing 106 are free to rotate (without load) around the first and second pivot arms 93A, 93B.

Other elements may include a spring assembly lower end 156, which allows the spring assembly to connect to the lower attachment bracket 165 via a locking pin 155; spring tension adjustor 157, which allows the force of the spring/piston assembly to be adjusted higher or lower. The spring tension adjuster 157 rotates around the spring assembly lower end 156 to compress or decompress the spring 158 to increase or reduce the resistive force. A spring lower housing 159 may be an outer sleeve within which an inner sleeve moves up and down along the z-axis, or it may be an outer housing of a piston, with an inner piston that moves up and down along the z-axis. A spring upper rod 160 may be an inner sleeve that moves up and down along the z-axis, within the spring lower housing 159, or may be the inner rod of a piston, that moves up and down along the z-axis, within the spring lower housing 159.

Embodiments of the first and second mechanical resistance elements 158A, 158B may include, by way of non-limiting examples, mechanical springs, spring/air cylinder combinations, pneumatic cylinders, hydraulic cylinders, electromechanical resistance devices such as linear actuators, torsion springs, compression springs, electro-magnetic devices, elastomer bands, mechanical gearing, etc., without limitation. The first and second mechanical resistance elements 158A, 158B are arranged to resist rotation of the horizontal resistance bar 3 about an axis of rotation defined by the distal ends of the first and second vertical support brackets 163A, 163B.

The first and second mechanical resistance elements 158A, 158B are arranged to resist rotation of the horizontal resistance bar 3 about an axis of rotation in either a compressive mode or a tension mode.

In one embodiment, one or both of the first and second mechanical resistance elements 158A, 158B are spiral wound torsion springs that are contained with or collocated with the first and second rotation retaining plates 39A, 39B.

In one embodiment, one or both of the first and second mechanical resistance elements 158A, 158B are fulcrum-based pivot bars.

This arrangement enables torque to be transmitted between the horizontally-disposed resistance bar 3 and the first and second rotation retaining plates 39A, 39B, with mechanical resistance introduced by the mechanical resistance element(s) 158 in combination with the respective one of the first and second outer eccentric brackets 162A, 162B of the respective first or second rotation retaining plate 39A, 39B and the respective first or second spring support arm 66A, 66B for therapeutic effect upon a user.

The frame 64, spring support arms 66A, 66B, legs 112, and various other elements of the embodiments of the therapeutic exercise machine 100 may be fabricated as tubular elements or pipes, bars, beams or similar elongated hollow pieces having round, square, rectangular or other cross-sections. The pieces may be fabricated from steel, aluminum, alloys thereof, wood or any wood-based material, or be engineered composite materials such as plastic composites, or be any such durable structural materials.

Similarly, other structural elements such as brackets 108, etc. may be fabricated from plate or flat steel, aluminum, alloy or other metals, wood or any wood-based material, or be engineered composite materials such as plastic composites, or any such durable materials.

The covers, grips, pads, cushions or caps for the frame or structural elements may be composed of foam, rubber, rubberized materials or plastics with similar qualities, nylon, vinyl or other polymeric materials. They may also be composed of a combination of several materials.

By using pre-loaded compressed air pistons (pneumatic pistons), hydraulic pistons, electromechanical resistance, mechanical gearing, electromechanical or mechanical brake mechanism or other devices that provide resistance or adjustable resistance to the user, the device is much lighter and more portable. As such, this device does not attach to a stack of weights, unlike many exercise devices for the lower back. This independence from the need to have a stack of weights, plates of weights or individual weights makes this device portable, so that it may be more easily used in the home. Furthermore, the arrangement of the therapeutic exercise machine 100 in the non-deployed state as described herein facilitates shipping and transporting.

By arranging the therapeutic exercise machine 100 in the non-deployed state, the device is transportable to allow in-home use and facilitate storage in a closet or other out of the way location. The narrow width of the therapeutic exercise machine 100, which is less than 36" in one embodiment and the addition of wheels 10 on the back or side, allow the therapeutic exercise machine 100 to be easily transported into the home environment and within the home environment, e.g., into and out of a storage room.

Figure 4:
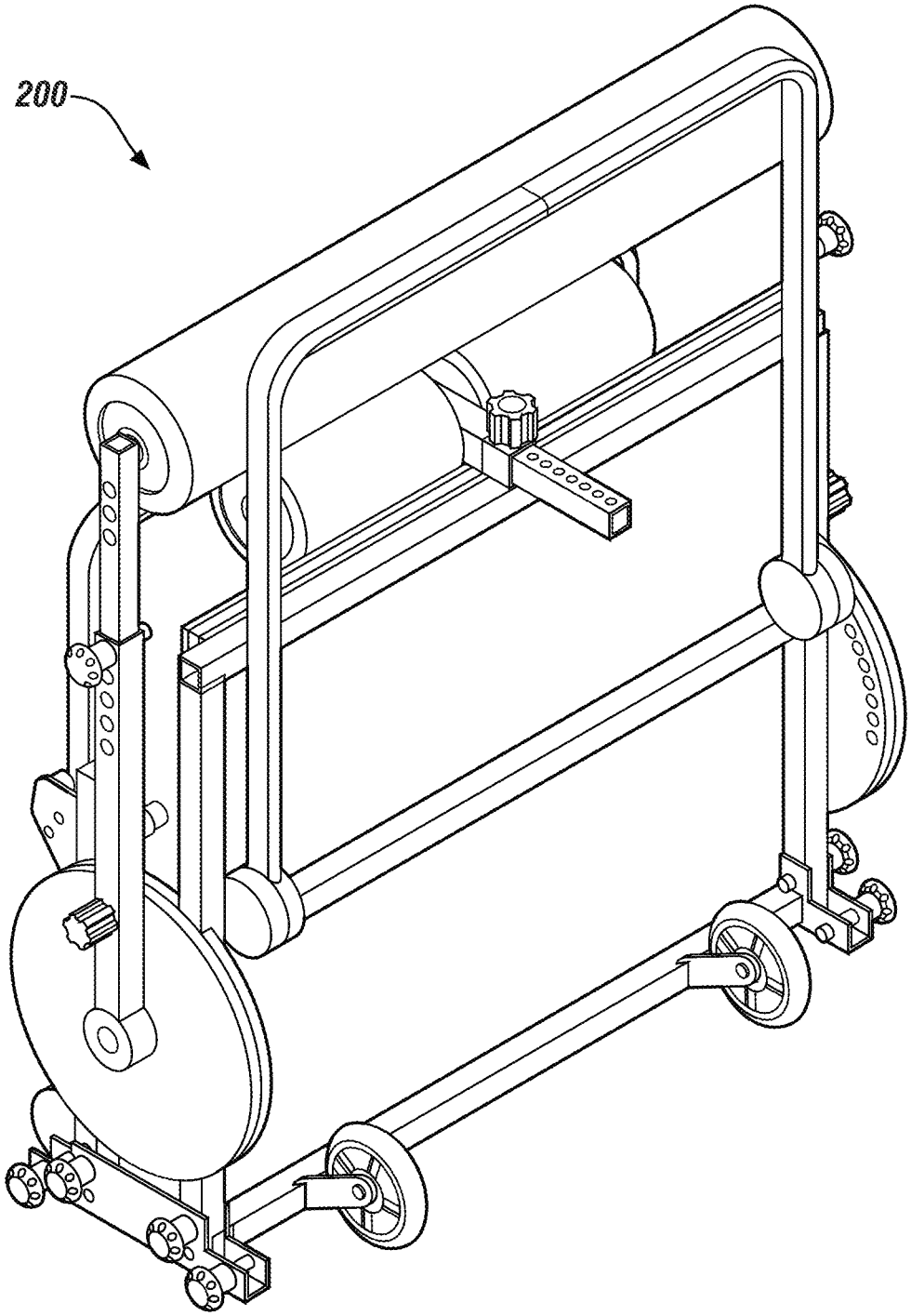
FIG. 4 schematically illustrates an isometric view of the second embodiment of the therapeutic exercise machine described with reference to FIG. 3 in a non-deployed state, in accordance with the disclosure.

FIGS. 3 and 4 schematically illustrate another embodiment of the therapeutic exercise machine 200, which may be employed in various exercise regimens for exercising muscles of the neck and/or lower back in either or both a clinical setting and a home setting. FIG. 3 depicts the therapeutic exercise machine 200 arranged in a deployed state, i.e., in-use. FIG. 4 depicts the therapeutic exercise machine 200 arranged in a non-deployed state. Like numerals indicate like elements.

The therapeutic exercise machine 200 includes a platform 65, a plurality of legs 112, first and second vertical support brackets 163A, 163B, respectively, a resistance bar assembly 140, back brace 114, a knee bolster 22, first and second mechanical resistance elements 158A, 158B, respectively, first and second spring support arms 66A, 66B, respectively, and one or a plurality of casters 10.

In this embodiment, the back brace 114 is mounted on and secured to the frame 64 via a mounting bracket 113. The back brace 114 has an attached extension arm 116 that is slidably disposed in the mounting bracket 113. This arrangement allows the back brace 114 to move back and forth along a horizontal axis, to position a user on the platform 65 in relation to the axis 146 and the rotation bar pivot housing 106 when in the deployed state using locking pin 115, and to facilitate collapse and relocation of the back brace 114 when the therapeutic exercise machine 200 is in the non-deployed state, as illustrated with reference to FIG. 4.

Other elements of the therapeutic exercise machine 100/200 described with reference to FIGS. 1 through 4 include as follows:

Knee pads—Used to cushion the user's knees.

Rotation bar locking pin-Engages with the rotation bar lower (pivot arm) 93 to either lock or release the Rotation bar upper (pivot arm).

Pivot arm rotation plate-when pinned with the Locking pin (rotation plate) 164 connects the rotation retaining plate 39 to the rotation bar pivot housing 106 and rotation bar lower (pivot arm) 93 allowing them to rotate (under load) around a pivot, rotation bar pivot axle 105. When the pin is released, the rotation retaining plate 39 and the rotation bar pivot housing 106 are free to rotate (without load) around the rotation bar lower (pivot arm) 93.

Spring tension adjustor allows the force of the spring/piston assembly to be adjusted higher or lower. The Spring tension adjuster 157 rotates around the spring assembly lower end 156 to compress or decompress one of the mechanical resistance elements 158A, 158B to increase or reduce the force.

Spring lower housing may be an outer sleeve within which an inner sleeve moves up and down along the z-axis, or may be the outer housing of a piston, with an inner piston that moves up and down along the z-axis.

Spring upper rod may be an inner sleeve that moves up and down along the z-axis, within the Spring lower housing 159, or may be the inner rod of a piston, that moves up and down along the z-axis, within the Spring lower housing 159.

Upper attachment bracket, which attaches the upper spring 161 to the first or second rotation retaining plate 39 allowing the force of the mechanical resistance device to be transferred into rotational force.

The first and second vertical support brackets 163A, 163B provide attachment points for the rotation bar pivot axle 105 and all parts that rotate around it.

Locking pin (rotation plate) connects the Rotation retaining plate 39 to the Rotation bar pivot housing 106 and rotation bar lower (pivot arm) 93 allowing them to rotate (under load) around a pivot, rotation bar pivot axle 105.

Pivot Bar (not visible) serves as a horizontal brace to connect the first and second vertical support brackets 163A, 163B, the rotation retaining plate 39, the rotation bar pivot housing 106 and the rotation bar lower (pivot arm) 93. It replaces the rotation bar pivot axle 105, in the embodiment without an adjustable back brace 114.

Figure 5:
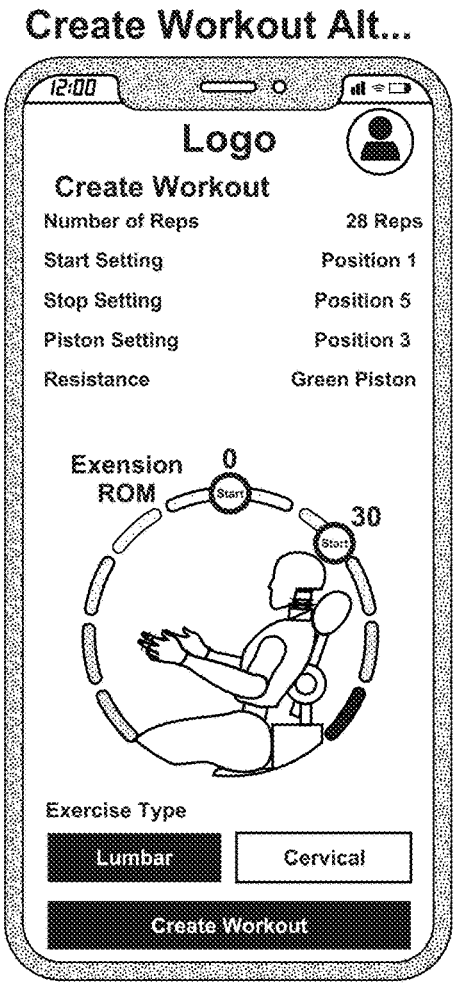
FIGS. 5 and 6 pictorially illustrate screenshots of a software application on a controller, in accordance with the disclosure.
Figure 6:
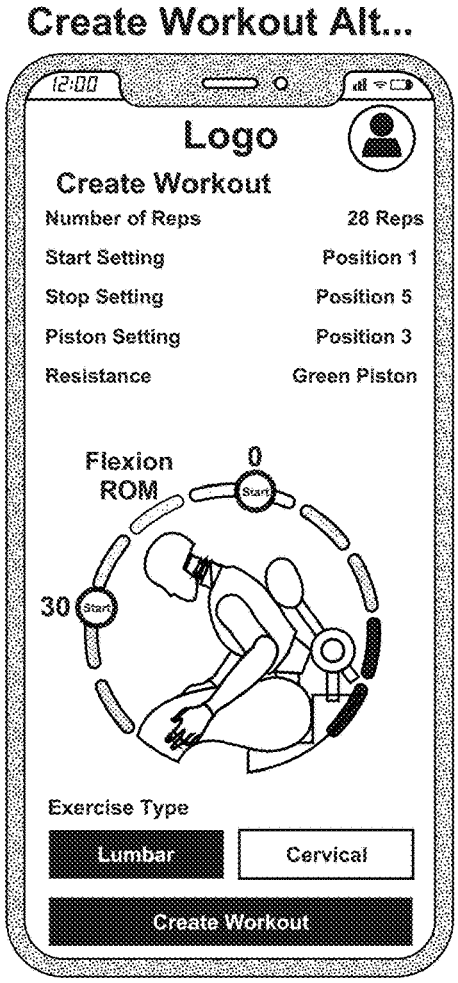

FIGS. 5 and 6 pictorially illustrate screen shots of a software application that may be executed on an embodiment of controller 19. The logo (LOGO) is an approximate location for where the name of the device and/or application name may be placed, but is not meant to indicate that this is the only location where the logo may be located. This application will have an account creation capability, with a user login and password required for access. It may require a user ID and password to access the main menu. Because the users may be patients under the care of a physician, user information may be collected to allow the user's usage information to be linked with their patient information, so that their progress may be reviewed by their physician. In the event that the user's usage information is not needed by a physician, the user's contact information may be used to create a unique account which will be used to monitor their progress.

The main screen will allow the user to navigate to sections of the application dedicated to workouts, progress tracking, instructional videos and even patient or user paperwork. It may also display useful information, such as points of contact, if the user needs additional help. Other sections may also be added.

In one embodiment, the controller 19 is a passive device that can be employed by the user to convey relevant information. The user may employ the controller 19 as an electronic computerized instructional device or application to set up training routines or regimens.

In one embodiment, the controller 19 may be linked via a wired connection, a Bluetooth connection, cellular connection or a WiFi connection to a sensor (not shown) and/or the mechanical resistance element(s) 158 of the therapeutic exercise machine 100. The controller 19 is able to monitor and capture usage information, such as frequency of use, duration of use, history of use, range of motion information, resistance levels and range of motion or strength improvement over time, and control parameters such as mechanical resistance of the mechanical resistance element(s) 158.

The concepts described herein provide a machine that is adjustable, to allow the exercise of both the cervical and lumbar muscles in one device.

The concepts described herein provide a machine that has a seat which is adjustable to accommodate users of varying size.

The concepts described herein provide a machine whose knee restraint system may be adjusted to accommodate users of varying size.

The concepts described herein device which is easily transportable to allow home use of the device. This may include reducing the physical size of the machine by designing it to be folded, collapsed, or disassembled when in the non-deployed state to achieve a smaller footprint for transportation as compared to when in use.

Some embodiments may incorporate the use of an electronic computerized instructional device or application linked to the device to allow the programming of resistance and range of motion limits to the exercises.

The design of the device described herein is such that in most embodiments the legs form an angle less than 120 degrees. This allows the device to have a compact design that takes up minimal space, lending itself to home use. This is unlike other known products, where the user is forced to position the legs in a more or less horizontal configuration, with legs bent at greater than 120 degrees. In one embodiment, a leg extension element may be employed to control a position of the user's legs, including positioning the user's legs in front of the user.

The disclosure includes devices and methods for exercising lumbar muscles or cervical neck muscles of a user while seated with hips firmly engaged against a back brace 114 at a rear portion of a seat, and with the legs suspended in front of the user and above the floor, with legs straight or lightly bent at the knees so that the thighs and calves form an obtuse angle of 100 to 180 degrees.

This device may be configured to be used for strengthening either or both the lumbar and cervical muscles.

For the embodiments that use means of resistance other than electromechanical resistance, the controller may still be used to measure number of repetitions, level of resistance, frequency of activity, duration of activity (length of use), Range of Movement for Extension and Flexion, improvement over time and other metrics either input by the user directly or captured through sensors. Transducers may be added to the Rotation retaining plate 39 to capture repetition data and resistance data.

The term "controller" may include a personal computer, tablet, cellular phone, or other device capable of one or more of the following functions: interfacing with a user via audible voice, hand gesturing, touch, or other means; capturing information from one or more sensors, compiling and/or analyzing information; controlling one or multiple actuators; and communicating with other devices. The term "controller" and related terms such as microcontroller, control, control unit, processor, etc. refer to one or various combinations of Application Specific Integrated Circuit(s) (ASIC), Field-Programmable Gate Array(s) (FPGA), electronic circuit(s), central processing unit(s), e.g., microprocessor(s) and associated non-transitory memory component (s) in the form of memory and storage devices (read only, programmable read only, random access, hard drive, etc.). The non-transitory memory component is capable of storing machine readable instructions in the form of one or more software or firmware programs or routines, combinational logic circuit(s), input/output circuit(s) and devices, signal conditioning, buffer circuitry and other components, which may be accessed by and executed by one or more processors to provide a described functionality. Input/output circuit(s) and devices include analog/digital converters and related devices that monitor inputs from sensors, with such inputs monitored at a preset sampling frequency or in response to a triggering event. Software, firmware, programs, instructions, control routines, code, algorithms, and similar terms mean controller-executable instruction sets including calibrations and look-up tables. Each controller executes control routine(s) to provide desired functions. Routines may be executed at regular intervals, for example every 100 microseconds during ongoing operation. Alternatively, routines may be executed in response to occurrence of a triggering event. Communication between controllers, actuators and/or sensors may be accomplished using a direct wired point-to-point link, a networked communication bus link, a wireless link, or another communication link. Communication includes exchanging data signals, including, for example, electrical signals via a conductive medium; electromagnetic signals via air; optical signals via optical waveguides; etc. The data signals may include discrete, analog and/or digitized analog signals representing inputs from sensors, actuator commands, and communication between controllers.

The term "signal" refers to a physically discernible indicator that conveys information, and may be a suitable waveform (e.g., electrical, optical, magnetic, mechanical or electromagnetic), such as DC, AC, sinusoidal-wave, triangular-wave, square-wave, vibration, and the like, that is capable of traveling through a medium.

A parameter is defined as a measurable quantity that represents a physical property of a device or other element that is discernible using one or more sensors and/or a physical model. A parameter may be a discrete value (e.g., either "1" or "0"), a percentage (e.g., 0% to 100%), or an infinitely variable value.

The detailed description and the drawings or figures are supportive and descriptive of the present teachings, but the scope of the present teachings is defined solely by the claims. While some of the best modes and other embodiments for carrying out the present teachings have been described in detail, various alternative designs and embodiments exist for practicing the present teachings defined in the claims.

What is claimed is:

1. A therapeutic exercise machine, comprising:
- a platform having a plurality of legs;
- first and second vertical support brackets affixed to the platform and proximal to a first end thereof;
- a resistance bar assembly having a resistance bar affixed to first and second rotation retaining plates via first and second pivot arms;
- first and second mechanical resistance devices;
- first and second spring support arms;
- a back brace; and
- a knee bolster, the knee bolster being affixed to a second end of the platform;
- wherein the first and second rotation retaining plates are rotatably attached to distal ends of the first and second vertical support brackets;
- wherein first ends of the first and second mechanical resistance devices are attached to the first and second spring support arms;
- wherein second ends of the first and second mechanical resistance devices are attached to the first and second rotation retaining plates; and
- wherein the first and second mechanical resistance devices are arranged to resist rotation of the resistance bar about an axis of rotation defined by the distal ends of the first and second vertical support brackets.

2. The therapeutic exercise machine of claim 1, wherein the therapeutic exercise machine is arrangeable in a deployed state and in a non-deployed state.

3. The therapeutic exercise machine of claim 2, wherein the therapeutic exercise machine being arranged in the non-deployed state comprises the legs, resistance bar assembly, the first and second mechanical resistance devices, and the first and second spring support arms being folded, disassembled, collapsed or retracted.

4. The therapeutic exercise machine of claim 2, further comprising a plurality of wheels arranged on the first end of the platform, wherein the plurality of wheels are in a bottom-most position on the therapeutic exercise machine when the therapeutic exercise machine is arranged in the non-deployed state.

5. The therapeutic exercise machine of claim 2, wherein the legs, the resistance bar assembly, the first and second mechanical resistance devices, and the first and second spring support arms are collapsible onto the platform when the therapeutic exercise machine is in the non-deployed state.

6. The therapeutic exercise machine of claim 2, wherein the platform is horizontally disposed and supported on the legs when the therapeutic exercise machine is in the deployed state.

7. The therapeutic exercise machine of claim 1, wherein the back brace is affixed to the first end of the platform.

8. The therapeutic exercise machine of claim 1, wherein the back brace is attached to and suspended between the vertical support brackets.

9. The therapeutic exercise machine of claim 1, further comprising the knee bolster having an adjustable mounting bracket, wherein the adjustable mounting bracket facilitates positioning of the knee bolster in relation to the platform.

10. The therapeutic exercise machine of claim 1, wherein the knee bolster, the back brace and the platform are adjustable to secure a user therein to effect exercise therapy.

11. The therapeutic exercise machine of claim 1, further comprising the first and second rotation retaining plates having eccentric brackets, wherein the second ends of the first and second mechanical resistance devices are attached to the eccentric brackets of the first and second rotation retaining plates.

12. The therapeutic exercise machine of claim 1, wherein at least one of the mechanical resistance devices comprises an electro-mechanical resistance device, a mechanical spring, a friction device, a pneumatic cylinder, a hydraulic cylinder and an electro-magnetic device, an elastomer band, or a mechanical gearing.

13. The therapeutic exercise machine of claim 1, further comprising the mechanical resistance device being controllable to adjust a magnitude of resistive mechanical force exertable by the mechanical resistance device.

14. The therapeutic exercise machine of claim 1, wherein at least one of the first and second mechanical resistance devices comprises a spiral wound torsion spring, and wherein the spiral wound torsion spring is disposed within a respective one of the first and second rotation retaining plates.

15. The therapeutic exercise machine of claim 1, wherein the first and second pivot arms comprise extendable telescoping arms.

16. The therapeutic exercise machine of claim 1, wherein at least one of the mechanical resistance devices comprises a fulcrum-based pivot bar.

17. A therapeutic exercise machine, comprising:

a platform having a plurality of foldable legs;

first and second vertical support brackets affixed to the platform at a first end thereof;

a resistance bar assembly having a resistance bar affixed to first and second rotation retaining plates via first and second pivot arms;

a mechanical resistance device;

a spring support arm;

a back brace; and a knee bolster, the knee bolster being affixed to a second end of the platform;

wherein the first and second rotation retaining plates are rotatably attached to distal ends of the first and second vertical support brackets;

wherein a first end of the mechanical resistance device is attached to the spring support arm;

wherein a second end of the mechanical resistance device is attached to one of the first and second rotation retaining plates;

wherein the mechanical resistance device is arranged to resist rotation of the resistance bar about an axis of rotation defined by the distal ends of the first and second vertical support brackets; and wherein the therapeutic exercise machine is arrangeable in a deployed state and in a non-deployed state.

18. The therapeutic exercise machine of claim 17, wherein the therapeutic exercise machine being arranged in the non-deployed state comprises the legs, resistance bar assembly, the mechanical resistance device, and the spring support arm being folded, disassembled, collapsed or retracted in relation to the platform.

19. The therapeutic exercise machine of claim 18, further comprising a plurality of wheels arranged on the first end of the platform, wherein the plurality of wheels are in a bottom-most position on the therapeutic exercise machine when the therapeutic exercise device is arranged in the non-deployed state.

20. The therapeutic exercise machine of claim 18, wherein the legs, the resistance bar assembly and the first and second spring support arms are foldable, disassembleable, collapsible, or retractable onto the platform when the therapeutic exercise machine is in the non-deployed state.

* * * * *